US011021831B2

(12) United States Patent
Kim

(10) Patent No.: US 11,021,831 B2
(45) Date of Patent: Jun. 1, 2021

(54) WASHING MACHINE AND OPERATING METHOD THEREOF

(71) Applicant: LG Electronics Inc., Seoul (KR)

(72) Inventor: Yunkeun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 167 days.

(21) Appl. No.: 16/193,469

(22) Filed: Nov. 16, 2018

(65) Prior Publication Data

US 2019/0153651 A1 May 23, 2019

(30) Foreign Application Priority Data

Nov. 17, 2017 (KR) ..... 10-2017-0154073

(51) Int. Cl.

| | |
|---|---|
| ***D06F 34/08*** | (2020.01) |
| ***D06F 37/30*** | (2020.01) |
| ***D06F 21/06*** | (2006.01) |
| ***D06F 33/00*** | (2020.01) |
| ***D06F 34/18*** | (2020.01) |
| *D06F 37/40* | (2006.01) |

(52) U.S. Cl.

CPC ..... *D06F 37/306* (2013.01); *D06F 21/06* (2013.01); *D06F 33/00* (2013.01); *D06F 34/18* (2020.02); *D06F 37/40* (2013.01); *D06F 2202/10* (2013.01); *D06F 2204/065* (2013.01)

(58) Field of Classification Search

CPC ..... D06F 34/08

See application file for complete search history.

(56) References Cited

U.S. PATENT DOCUMENTS

2016/0130739 A1* 5/2016 Song ..... D06F 37/40 8/137

* cited by examiner

*Primary Examiner* — Jason Y Ko

(74) *Attorney, Agent, or Firm* — Fish & Richardson P.C.

(57) ABSTRACT

Disclosed is an operating method of a washing machine, the operating method comprising operating a drum accommodating a laundry in a first mode of rotating the drum clockwise or counterclockwise at least once, operating the drum in a second mode of rotating the drum at a speed which is higher than a rotation speed in the first mode, and operating the drum in a third mode of accelerating the drum, maintaining a rotation speed of the drum, and decelerating the drum.

11 Claims, 6 Drawing Sheets

WASHING MACHINE AND OPERATING METHOD THEREOF

CROSS-REFERENCE TO RELATED APPLICATIONS

This application claims the benefit of the Korean Patent Application No. 10-2017-0154073 filed on Nov. 17, 2017, which is hereby incorporated by reference as if fully set forth herein.

BACKGROUND

Field of the Invention

The present invention relates to a washing machine and an operating method thereof.

Discussion of the Related Art

Generally, washing machines are devices for removing pollutants from the polluted laundry through a washing process, a rinsing process, and a dehydrating process. Washing machines may each include a cabinet configuring an external appearance, a tub installed in the cabinet to store water, and a drum rotatably installed in the tub.

In a state where the laundry and washing water are put in the drum along with detergent, a washing machine rotates the drum to apply a physical impact to the laundry, thereby washing the laundry. At this time, in a washing process, the washing machine rotates a pulsator at a low speed to perform washing, and in a dehydrating process, the washing machine simultaneously rotates the pulsator and the drum at a high speed to perform dehydration. That is, washing machines have a structure which operates in two modes.

As described above, washing machines may each include a clutch for operating in the two modes, and an operation mode may be changed when a coupler included in the clutch is raised or lowered.

As the coupler is raised, the coupler may be detached from a pulsator shaft, and as the coupler is lowered, the coupler may be connected to the pulsator shaft. For example, in a case where the coupler is unstably connected to a motor, an abnormal value may be sensed in a subsequent washing process. Therefore, a method for increasing a fastening success rate between the coupler and the motor may be needed for washing machines.

SUMMARY

An aspect of the present invention is directed to providing a washing machine and an operating method thereof, which minimize a probability that a coupler is unstably coupled to a motor. That is, the present invention provides a washing machine and an operating method thereof, which compensate for a coupling defect between a coupler and a motor.

To achieve these and other advantages and in accordance with the purpose of the disclosure, as embodied and broadly described herein, there is provided a washing machine comprising a pulsator shaft configured to rotate a pulsator, a drum shaft configured to rotate a drum, a carrier connected to the drum shaft, a motor comprising a stator and a rotor, a coupler spline-coupled to the carrier and detachably connected to the rotor, a clutch motor configured to raise or lower the coupler, and a controller configured to perform a first mode of controlling the clutch motor to a clutching mode and rotating the drum clockwise or counterclockwise at least once, a second mode of rotating the drum at a higher speed than the first mode, and a third mode of accelerating the drum, maintaining a rotation speed of the drum, and decelerating the drum.

The controller sequentially performs the first mode, the second mode, and the third mode.

In the second mode, the controller rotates the drum in one direction of a clockwise direction and a counterclockwise direction.

In the second mode, the controller rotates the drum in a direction which is opposite to a rotational direction of the drum in a previous dehydrating process.

A maximum rotation speed of the drum in the second mode is faster than a maximum rotation speed of the drum in the first mode and is equal to or slower than a maximum rotation speed of the drum in the third mode.

In each of the second mode and the third mode, the controller accelerates a rotation of the drum, and an acceleration of the drum in the second mode is 0.8 to 1.2 times an acceleration of the drum in the third mode.

In the first mode, the controller alternately rotates the drum clockwise and counterclockwise, in the second mode, the controller accelerates the drum up to a first target speed which is faster than a maximum speed in the first mode, and decelerates the drum, and in the third mode, the controller accelerates the drum up to the first target speed, maintains the first target speed as a uniform speed for a predetermined time, and decelerates the drum up to a second target speed which is slower than the first target speed.

The controller sequentially performs the first mode and the second mode, and in the third mode, the controller senses an amount of laundry.

In the third mode, the controller senses the amount of laundry, based on a time required for deceleration from the first target speed to the second target speed.

In the second mode, the controller sequentially performs a first process of stopping and maintaining the drum, a second process of accelerating the drum up to a first target speed after the first process and decelerating the drum, and a third process of stopping and maintaining the drum after the second process.

In the second mode, a time taken in the third process is longer than a time taken in the first process.

There is provided an operating method of a washing machine, the operating method comprising operating a drum accommodating a laundry in a first mode of rotating the drum clockwise or counterclockwise at least once, operating the drum in a second mode of rotating the drum at a speed which is higher than a rotation speed in the first mode, and operating the drum in a third mode of accelerating the drum, maintaining a rotation speed of the drum, and decelerating the drum.

In the second mode, the drum rotates in one direction of a clockwise direction and a counterclockwise direction.

In the second mode, the drum rotates in a direction which is opposite to a rotational direction of the drum in a previous dehydrating process.

A maximum rotation speed of the drum in the second mode is faster than a maximum rotation speed of the drum in the first mode and is equal to or slower than a maximum rotation speed of the drum in the third mode.

Each of the second mode and the third mode comprises a process of accelerating a rotation of the drum, and an acceleration of the drum in the second mode is 0.8 to 1.2 times an acceleration of the drum in the third mode.

In the first mode, the drum rotates alternately and repeatedly in a normal direction and a reverse direction, in the second mode, the drum is accelerated up to a first target speed which is faster than a maximum speed in the first mode, and is decelerated, and in the third mode, the drum is accelerated up to the first target speed, maintains the first target speed as a uniform speed for a predetermined time, and is decelerated up to a second target speed which is slower than the first target speed.

The first mode and the second mode are sequentially performed, and in the third mode, an amount of laundry is sensed.

In the third mode, the amount of laundry is sensed based on a time required for deceleration from the first target speed to the second target speed.

The operating of the drum in the second mode comprises sequentially performing a first process of stopping and maintaining the drum, a second process of accelerating the drum up to a first target speed after the first process and decelerating the drum, and a third process of stopping and maintaining the drum after the second process.

A time taken in the third process is longer than a time taken in the first process.

DETAILED DESCRIPTION OF THE DISCLOSURE

Hereinafter, embodiments relating to the present invention will be described in detail with reference to the accompanying drawings.

<Washing Machine>

Figure 1:
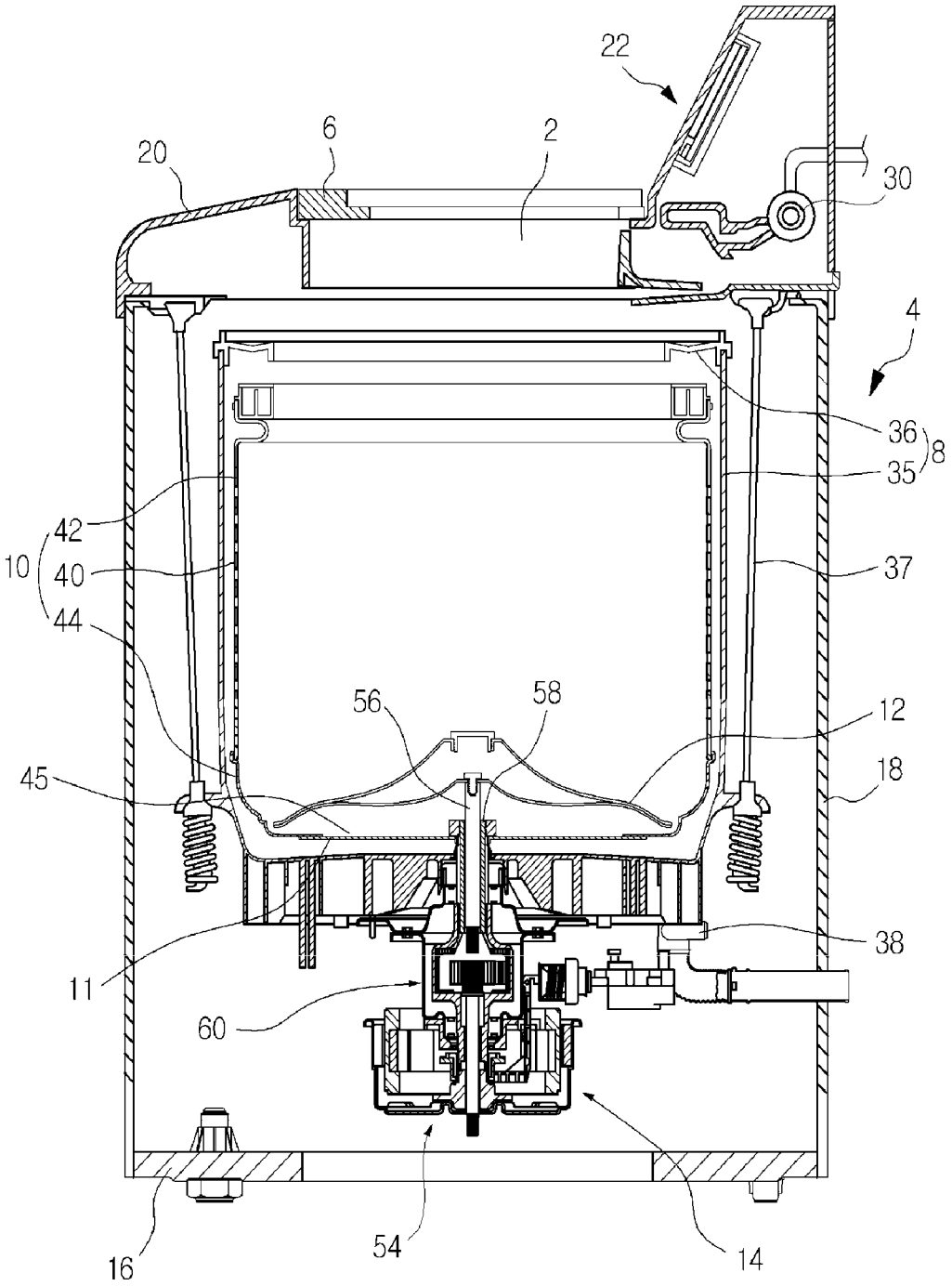
FIG. 1 is a cross-sectional view schematically illustrating a structure of a washing machine according to the present invention.

FIG. 1 is a cross-sectional view schematically illustrating a structure of a washing machine according to the present invention.

Referring to FIG. 1, the washing machine according to the present invention may include a cabinet 4 where a laundry entrance 2 is provided in an upper portion thereof, a lid 6 which opens/closes the laundry entrance 2, a tub 8 which is installed in the cabinet 4 to store washing water, a drum 10 which is rotatably provided in the tub 8 to accommodate the laundry, a pulsator 12 which is installed in a lower end of the drum 10 and stirs from side to side to generate a water flow, and a driving mechanism 14 which is installed to rotate the drum 10 and the pulsator 12.

The cabinet 4 may form an external appearance of the washing machine. The cabinet 4 may include a base 16, a cabinet body 18 which is disposed on the base 16, and a top cover 20 which is disposed on a top of the cabinet body 18 and where the laundry entrance 20 is provided.

A control panel 22 for controlling the washing machine and displaying information about the washing machine may be installed in the cabinet 4. A plurality of water supply valves 30 through which water such as hot water and cold water is supplied may be installed inside the control panel 22.

The lid 6 may be a type of door which opens the laundry entrance 2 in a laundry loading/unloading process and closes the laundry entrance 2 in a washing, rinsing, or dehydrating process. The lid 6 may be provided to be opened upward and closed downward with respect to a rear portion.

The tub 8 may be an external tank or a water storing tank in which washing water or rinsing water is put in washing or rinsing and which collects water flowing out from the drum 10 in dehydration. A top of the tub 8 may be opened for loading or unloading the laundry.

The tub 8 may include a tub body 35 and a tub cover 36 installed on the tub body 35.

The tub 8 may be connected to the cabinet 4 by a suspension mechanism 37.

A drainage mechanism 38, through which washing water, rinsing water, or water dehydrated from the laundry is drained, may be connected to the tub 8. The drainage mechanism 38 may include a drainage valve controlled by the control panel 22 and a drainage hose connected to the drainage valve.

The drum 10 may be an internal tank or a washing tank, in which the laundry is put. A top of the drum 10 may be opened for taking in or out the laundry, and the drum 10 may be rotatably disposed inside the tub 8.

The drum 10 may include a plurality of water holes 40 through which washing water or rinsing water moves to the inside or outside of the drum 10 and through which water dehydrated from the laundry is discharged to the outside of the drum 10.

The drum 10 may be provided in a hollow cylindrical shape. The drum 10 may include a drum body 42 which forms a perimeter appearance of the drum 10 and a drum base 44 which is coupled to a lower portion of the drum body 42 and forms a lower appearance of the drum 10.

A pulsator shaft 56 may pass through a center of the drum base 44. A center hole 45, through which washing water, rinsing water, and water dehydrated from the laundry passes, may be provided in the drum base 44.

A hub 62, which is connected to the driving mechanism 14 to transfer a rotational force of the driving mechanism 14 to the drum 10, may be installed in the drum 10.

A center of the hub 62 may be connected to a drum shaft 58 of the driving mechanism 14, and a portion, other than the center, of the hub 62 may be connected to the drum base 44 by a plurality of fastening members. Therefore, the hub 62 may transfer the rotational force, transferred through the drum shaft 58, to the drum base 44 through a plurality of portions other than the center.

The pulsator 12 may stir washing water, rinsing water, and the laundry while rotating inside the drum 10. The driving mechanism 14 may be connected to the pulsator shaft 56.

<Driving Mechanism>

Figure 2:
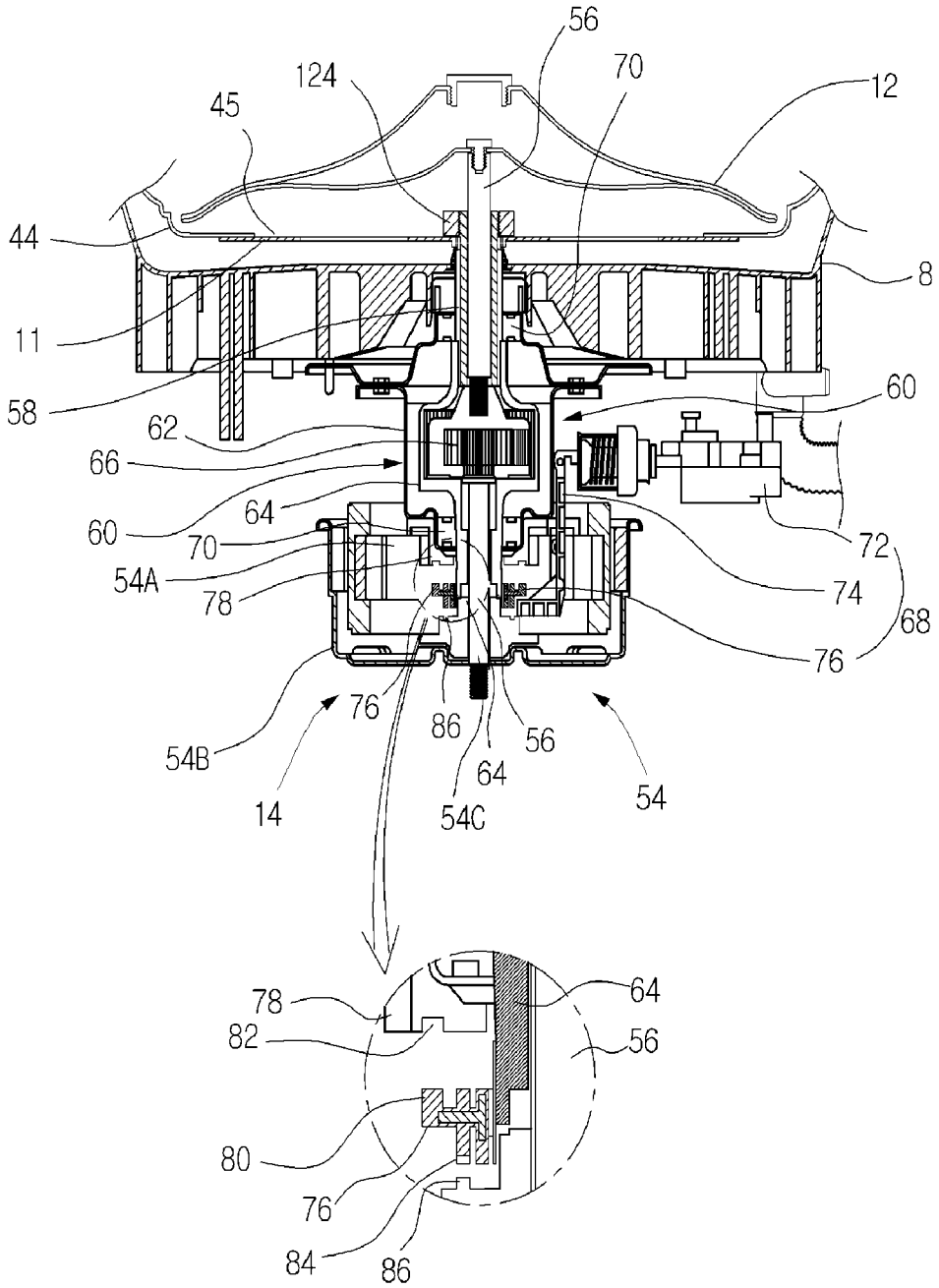
FIG. 2 is an enlarged view of a driving mechanism of the washing machine according to an embodiment of the present invention.

FIG. 2 is an enlarged view of a driving mechanism of the washing machine according to an embodiment of the present invention.

As illustrated in FIG. 2, the driving mechanism 14 may rotate the pulsator 12, or may rotate both the pulsator 12 and the drum 10. The driving mechanism 14 may include a motor 54 which is a driving source, the pulsator shaft 56 which is connected to the pulsator 12, the drum shaft 58 which is installed to rotate the drum 10, and a clutch 60 which transfers a driving force of the motor 54 to the pulsator shaft 56 or transfers the driving force of the motor 54 to both the pulsator shaft 56 and the drum shaft 58.

The motor 54 may include a stator 54A coupled to the clutch 60, a rotor 54B rotated by the stator 54A, and a rotational shaft 54C connected to the rotor 54B.

The drum shaft 58 may be configured as a hollow shaft in order for the pulsator shaft 56 to be rotatably located therein, and an upper portion thereof may be connected to the hub 11.

The driving shaft may include the pulsator shaft 56 and the drum shaft 58 which is a hollow tube configuring a concentric circle with the pulsator shaft 56 and is connected to the drum 10.

The clutch 60 may include a bearing housing 62 which is fixed to a lower portion of the tub 8, a carrier 64 which is rotatably installed in the bearing housing 62 and is connected to the drum shaft 58, a planet gear set 66 which is disposed in the carrier 66 so as to reduce a dynamic force of the motor 54 and is connected to the pulsator shaft 56, and a clutch mechanism 68 which is installed under the carrier 64 to control dynamic force transfer between the motor 54 and the carrier 64.

A plurality of ball bearings 70 may be provided in the bearing housing 62 and may rotatably support the carrier 64 and the drum shaft 58.

The motor 54 may be equipped in the bearing housing 62 so that the stator 54A is disposed under the carrier 64, and the rotational shaft 54C may pass through the stator 54A and may be connected to the planet gear set 66 disposed in the carrier 64.

The clutch mechanism 68 may include a clutch motor 72 which is provided on a bottom of the tub 8, a clutch lever 74 which is connected to the clutch motor 72 at one side thereof, and a coupler 76 which is connected to the other side of the clutch lever 74 and is movably spline-coupled to a lower portion of the carrier 64 in order for the rotational force of the motor 54 to be selectively transferred/blocked to the carrier 64.

A stopper 78 for restraining the coupler 76 may be installed in the bearing housing 62.

A plurality of projections 80 may be provided on a top of the coupler 76, and a plurality of projection inserting grooves 82 which the plurality of projections 80 are respectively inserted into and hung on may be provided in the stopper 78.

A motor coupling part 84 which is coupled to or detached from the motor 54 (for example, the rotor 54B) may be provided in the coupler 76, and a coupler coupling part 86 which the motor coupling part 84 is lowered and inserted into and which the motor coupling part is raised and detached from may be provided in the rotor 54B.

<Coupler>

Figure 3:
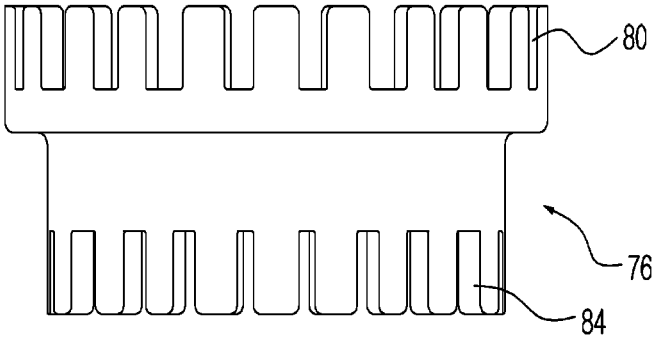
FIG. 3 is a side view of the coupler illustrated in FIG. 2.
Figure 4:
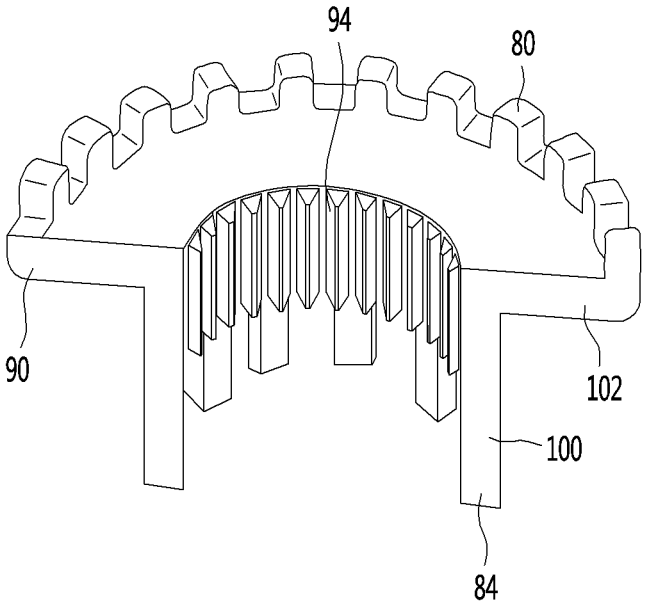
FIG. 4 is a partial cut-away perspective view of the coupler illustrated in FIG. 3.

FIG. 3 is a side view of the coupler illustrated in FIG. 2, and FIG. 4 is a partial cut-away perspective view of the coupler illustrated in FIG. 3.

As illustrated in FIG. 3, the coupler 76 may include the plurality of projections 80 assembled or disassembled to or from the stopper 78, the motor coupling part 84 coupled to or detached from the motor 54, and a carrier coupling part 94 spline-coupled to the carrier 64.

The carrier coupling part 94 may be provided in a spline tooth shape so that the coupler 76 engages with an outer circumference surface of the carrier 64 to rotate when the coupler 76 is coupled to the carrier 64. The carrier coupling part 94 may be provided in a shape which engages with a spline groove provided in an outer circumference surface of the carrier coupling part 94.

When the coupler 76 moves in an axial direction (i.e., an ascending direction), the carrier coupling part 94 may move while sliding along a spline groove provided in the carrier 64, and when the coupler 76 rotates, the carrier coupling part 94 may rotate along with the carrier 64.

The coupler 76 may be provided in a hollow cylindrical shape. The coupler 76 may include a cylindrical part 100, where the carrier coupling part 94 spline-coupled to the carrier 64 is provided on an internal circumference surface of the coupler 76 and the motor coupling part 84 is provided in a lower portion thereof, and a horizontal part 102 which protrudes horizontally from an outer circumference of the cylindrical part 100 and where the plurality of projections 80 are provided on a top thereof.

<Pulsator Rotation Based on Raising of Coupler>

In a process of driving the motor 54, when the clutch motor 72 is driven in a pulsator rotation mode, the clutch lever 74 may raise the coupler 76. The coupler 76 may be raised along the carrier 64, and the motor coupling part 84 may be detached from the rotor 54A of the motor 54. At this time, the plurality of projections 80 of the coupler 76 may be inserted into the projection inserting grooves 82 of the stopper 78 and restrained, and thus, without the projections 80 rotating, the drum 10 may not rotate.

At this time, the planet gear set 66 may rotate the pulsator shaft 56 in cooperation with driving of the motor 54, and the pulsator shaft 56 may rotate the pulsator 12.

<Drum Rotation Based on Lowering of Coupler>

In a process of driving the motor 54, when the clutch motor 72 is driven in a drum simultaneous rotation mode, the clutch lever 74 may lower the coupler 76. Since the coupler 76 is lowered, the plurality of projections 80 may be detached from the projection inserting grooves 82 of the stopper 78, and the motor coupling part 84 may be coupled to the rotor 54A of the motor 54.

At this time, the coupler 76 may transfer a driving force of the motor 54 to the carrier 64. When the carrier 64 rotates, the drum shaft 58 may rotate along with the carrier 64, and the drum shaft 58 may rotate the drum 10.

<Coupler Unfastened>

In a process of lowering the coupler 76, the motor coupling part 84 may be unstably coupled to the rotor 54B.

Figure 5:
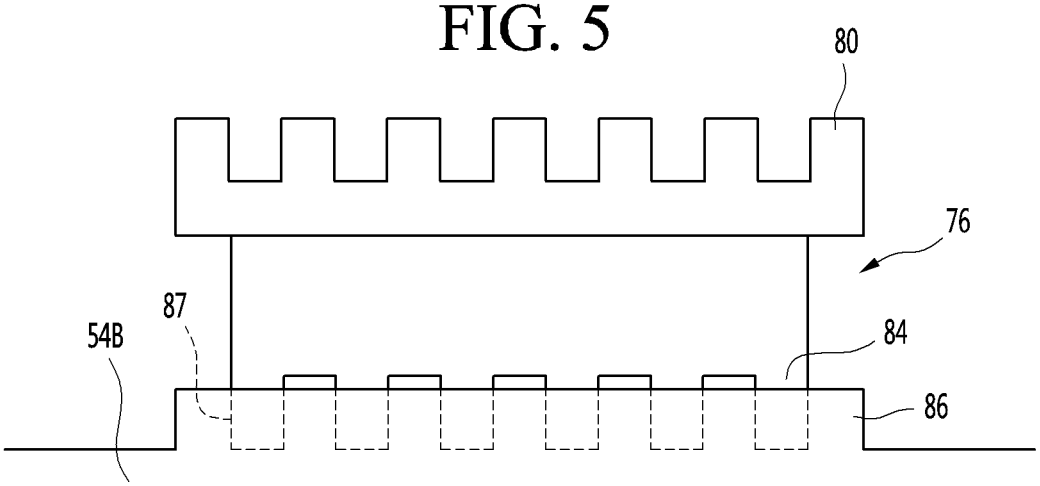
FIG. 5 is a diagram illustrating an example where a coupler according to an embodiment of the present invention is normally fastened to a rotor of a motor.
Figure 6:
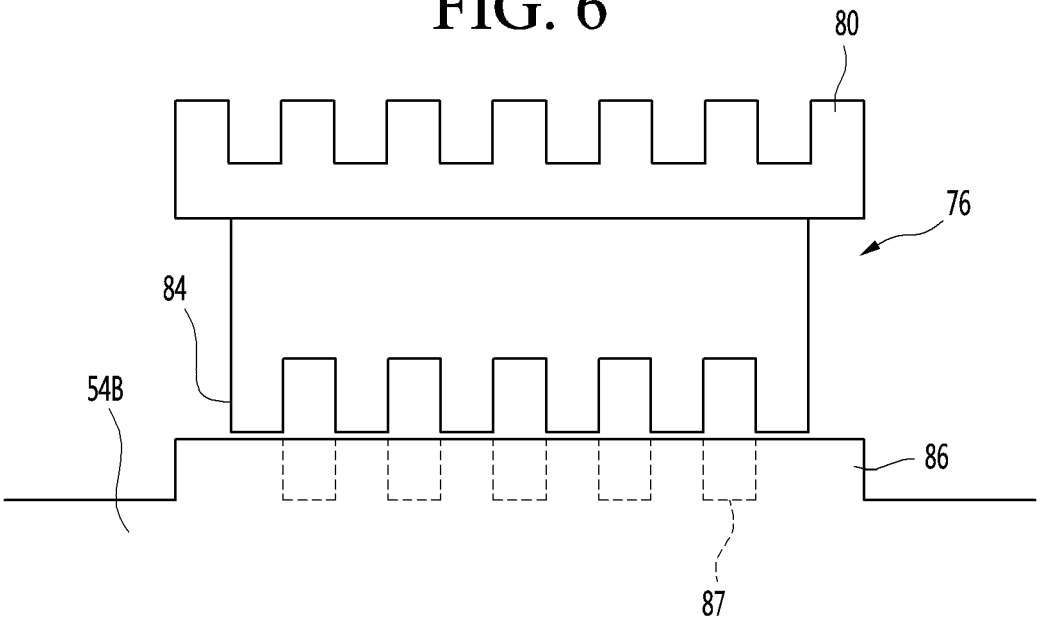
FIG. 6 is a diagram illustrating an example where the coupler according to an embodiment of the present invention is not normally fastened to the rotor of the motor.

FIG. 5 is a diagram illustrating an example where a coupler according to an embodiment of the present invention is normally fastened to a rotor of a motor, and FIG. 6 is a diagram illustrating an example where the coupler according to an embodiment of the present invention is not normally fastened to the rotor of the motor.

The coupler coupling part 86 selectively coupled/detached to/from the coupler 76 may be provided in the rotor 54B of the motor 54, and a coupler coupling groove 87 into which the motor coupling part 84 provided in the coupler 76 is inserted may be provided in the coupler coupling part 86.

Therefore, in a process of lowering the coupler 76, when the motor coupling part 84 is inserted into the coupler coupling groove 87, the coupler 76 may be fastened to the motor 54, and in a process of lowering the coupler 76, when the motor coupling part 84 is not inserted into the coupler coupling groove 87, the coupler 76 may not normally be fastened to the motor 54.

In a case where a controller 90 lowers the coupler 76, the controller 90 cannot know a position relationship between the motor coupling part 84 and the coupler coupling groove 87. For this reason, as illustrated in FIG. 5, the motor coupling part 84 may be inserted into the coupler coupling groove 87, or as illustrated in FIG. 6, the motor coupling part 84 may not be inserted into the coupler coupling groove 87.

In this case, the motor 54 may be driven in order for the coupler 76 to be normally fastened. That is, the motor 54 may rotate the rotor 54B at a predetermined rotation speed so that, when the coupler 76 is lowered, the motor coupling part 84 is inserted into the coupler coupling groove 87. Based on the rotation of the rotor 54B, the motor coupling part 84 which is not yet inserted into the coupler coupling groove 87 may be inserted into the coupler coupling groove 87.

However, despite driving of the motor 54, a fastening defect where the coupler 76 is not normally fastened may occur.

In this manner, in a state where a fastening defect where the coupler 76 is not normally fastened occurs, when a subsequent washing process is performed, the motor 54 may be driven and the rotor 54B may rotate, whereby the coupler 76 may be fastened to the motor 54.

However, if a washing process performed immediately after a fastening defect occurs is a washing process of sensing data such as sensing the amount of laundry, the coupler 76 may be fastened in a subsequent washing process, and an abnormal value may occur in the data.

Figure 7:
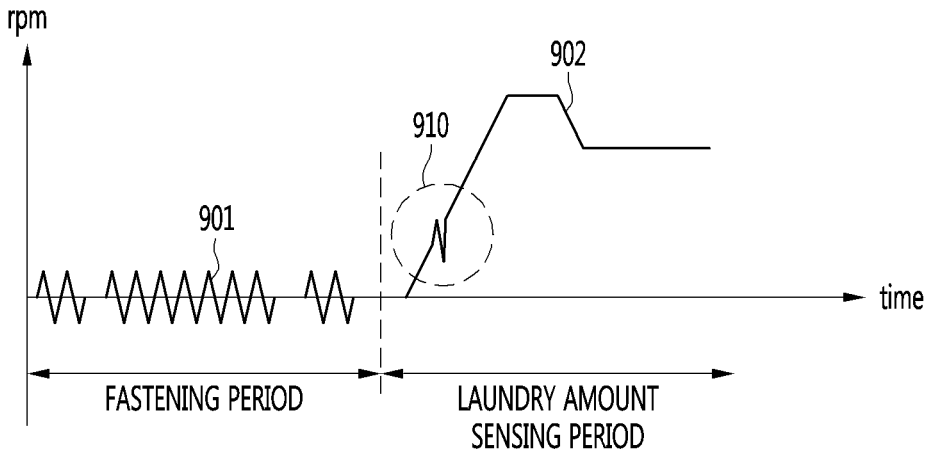
FIG. 7 is a diagram for describing a problem caused by a fastening defect of the coupler according to an embodiment of the present invention.

FIG. 7 is a diagram for describing a problem caused by a fastening defect of the coupler according to an embodiment of the present invention.

A graph illustrated in FIG. 7 represents a rotation speed of the drum 10 with respect to a time.

A fastening period may be a period where the clutch mode 72 operates in a clutching mode. That is, a fastening period may be a period where the clutch motor 72 lowers the coupler 76 in order for the coupler 76 to be fastened to the motor 54.

The motor 54 may be driven in order for the motor coupling part 84 to be coupled to the rotor 54B in the fastening period. A first graph 901 may show a rotation speed of the drum 10 in the fastening period.

According to the first graph 901, in the fastening period, a maximum rotation speed of the drum 10 may be a first rotation speed. The first rotation speed may be 10 RPM, but this is merely an embodiment.

A laundry amount sensing period may be a period where the amount of laundry included in the drum 10 is sensed. The laundry amount sensing period may be a period where the motor 54 is driven at a certain driving speed to rotate the drum 10, and thus, the amount of laundry is sensed.

Sensing the amount of laundry may be performed by rotating the pulsator 12, or may be performed by rotating both the pulsator 12 and the drum 10. In the present invention, an example where sensing the amount of laundry is performed by rotating both the pulsator 12 and the drum 10 will be described below.

The motor 54 may be driven for sensing the amount of laundry. A second graph 902 may show a driving speed of the motor 54 in the laundry amount sensing period.

According to the second graph 902, in the laundry amount sensing period, a maximum rotation speed of the drum 10 may be a second rotation speed. The second rotation speed may be 50 RPM, but this is merely an embodiment.

Referring to the second graph 902, the laundry amount sensing period may include a bounce period 910. The bounce period 910 may denote a period where a rotation speed of the drum 10 temporarily varies by a certain value or more. In the bounce period 910, when the coupler 75 is not normally fastened, a rotation speed of the drum 10 may increase, and due to this, the motor coupling part 84 provided in the coupler 76 may be inserted into the coupler coupling groove 87 provided in the rotor 54B.

As described above, when the bounce period 910 occurs in the laundry amount sensing period, a laundry amount value which is a laundry amount sensing result may be sensed as an abnormal value. For this reason, since the amount of laundry is not accurately sensed, the amount of washing water, the amount of detergent, a washing intensity, and the like may be abnormally set, and due to this, energy may be wasted or a washing process may not normally be performed, causing the reduction in reliability.

Therefore, the washing machine according to an embodiment of the present invention may sequentially perform the clutching mode of lowering the coupler 76, a mode of compensating for a coupling defect of the coupler 76, and the laundry amount sensing mode.

Figure 8:
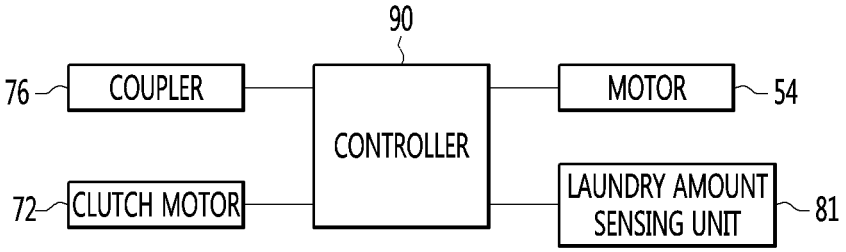
FIG. 8 is a block diagram for describing a washing machine for performing a coupling defect compensation operation according to an embodiment of the present invention.
Figure 9:
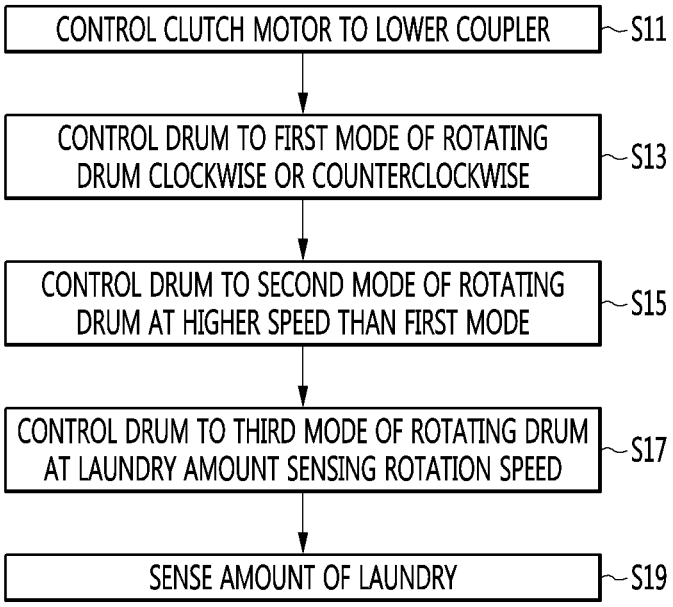
FIG. 9 is a flowchart illustrating a method of performing, by the washing machine according to an embodiment of the present invention, the coupling defect compensation operation.

FIG. 8 is a block diagram for describing a washing machine for performing a coupling defect compensation operation according to an embodiment of the present invention, and FIG. 9 is a flowchart illustrating a method of performing, by the washing machine according to an embodiment of the present invention, the coupling defect compensation operation.

The washing machine according to an embodiment of the present invention may include a coupler 76, a clutch motor 72, a motor 54, a laundry amount sensing unit 81, and a controller 90. The controller 90 may control the clutch motor 72, the motor 54, and the laundry amount sensing unit 81. Also, the washing machine according to an embodiment of the present invention may further include other elements in addition to the elements illustrated in FIG. 8.

The coupler 76, the clutch motor 72, and the motor 54 are the same as the above descriptions, and thus, their detailed descriptions are omitted.

The laundry amount sensing unit 81 may rotate the drum 10 to sense the amount of laundry included in the drum 10.

According to an embodiment, the controller 90 may rotate the drum 10 at a laundry amount sensing rotation speed in a laundry amount sensing mode, and at this time, the laundry amount sensing unit 81 may measure a time for which a rotation speed of the drum 10 is decelerated, thereby sensing the amount of laundry.

The laundry amount sensing rotation speed may include a period where a rotation speed is accelerated to a first target speed, maintained as a uniform speed, and decelerated to a second target speed.

For example, the laundry amount sensing unit 81 may sense a laundry amount level in proportion to a time for which a rotation speed of the drum 10 is decelerated. That is, as a time for which a rotation speed of the drum 10 is decelerated becomes longer, the laundry amount sensing unit 81 may sense a laundry amount level as a high level. The laundry amount sensing unit 81 may sense that a first laundry amount level when a time for which a rotation speed of the drum 10 is decelerated is a first time is higher than a second laundry amount level when a time for which a rotation speed of the drum 10 is decelerated is a second time.

The laundry amount sensing unit 81 may measure a time for which a rotation of the drum 10 is accelerated when rotating the drum 10, thereby sensing the amount of laundry.

However, a laundry amount sensing method is technology known to those skilled in the art, and thus, its detailed description is omitted. The present embodiment is not limited to the above-described laundry amount sensing method.

The controller 90 may control an overall operation of the washing machine.

In detail, the controller 90 may control the clutch motor 72 in order for the coupler 76 to be raised or lowered. Also, the controller 90 may perform control to rotate the motor 54, or may perform control in order for the laundry amount sensing unit 81 to sense the amount of laundry.

According to an embodiment of the present invention, the controller 90 may control the clutch motor 72 to the clutching mode, and the clutch motor 72 may lower the coupler 76 in the clutching mode.

As illustrated in FIG. 9, the controller 90 may control the clutch motor 72 in order for the coupler 76 to be lowered (S11).

At this time, based on a position of the coupler 76 and a position of the rotor 54B of the motor 54, the motor coupling part 84 provided in the coupler 76 may be inserted or not into the coupler coupling groove 67 provided in the rotor 54B.

Therefore, the controller 90 may control the drum 10 to a first mode of clockwise or counterclockwise rotating the drum 10 (S13).

That is, the controller 90 may control the clutch motor 72 to the clutching mode and may control the drum 10 to the first mode of clockwise or counterclockwise driving the drum 10 at a first rotation speed. In the first mode, the drum 10 may rotate at the first rotation speed, and the rotor 54B may alternately and repeatedly rotate in a clockwise direction and a counterclockwise direction. In the first mode, the rotor 54B may rotate in the clockwise direction and the counterclockwise direction at least once. In such a process, the motor coupling part 84 provided in the coupler 76 may be inserted into the coupler coupling groove 67 provided in the rotor 54B.

The controller 90 may control the drum 10 to the first mode, and then, may control the drum 10 to a second mode of rotating the drum 10 at a higher speed than the first mode (S15).

That is, the controller 90 may control the first mode to the second mode so as to compensate for a case where the coupler 76 is not normally fastened to the rotor 54B in the first mode.

In the second mode, the controller 90 may rotate the drum 10 in one of the clockwise direction and the counterclockwise direction.

In the second mode, the controller 90 may rotate the drum 10 in one of the clockwise direction and the counterclockwise direction once.

In the second mode, the controller 90 may sequentially perform a first process of stopping and maintaining the drum 10, a second process of accelerating a rotation speed of the drum 10 up to a target speed after the first process and decelerating the drum 10, and a third process of stopping and maintaining the drum 10 after the second process.

The first process may be a process of initializing a rotation speed value of the drum 10 after performing the first mode.

A rotation speed of the drum 10 may be more accurately measured in a case, where the first process is performed before the drum 10 is accelerated (the second process) to the target speed in the second mode after the first mode is performed, than a case where the first process is not performed before the drum 10 is accelerated (the second process) to the target speed in the second mode after the first mode is performed. That is, when the first process is performed, whether to reach the target speed may be accurately measured, thereby enhancing reliability.

The second process may be a process of rotating the rotor 54B in order for the coupler 76 to be normally fastened to the rotor 54B.

According to an embodiment, the controller 90 may rotate in a direction opposite to a direction in which the rotor 54B rotates in a dehydrating process. In this case, the rotor 54B may rotate in a direction opposite to a direction in which the rotor 54B rotates at a high speed in a previous washing process, and thus, a relatively stronger torque may be applied thereto and the coupler 65 may be much better coupled to the rotor 54B.

According to an embodiment, the controller 90 may perform control in order for the drum 10 to rotate at a faster second rotation speed than a first rotation speed in the second mode. In detail, a maximum rotation speed of the drum 10 in the second mode may be faster than a maximum rotation speed of the drum 10 in the first mode and may be equal to or slower than a maximum rotation speed of the drum in a below-described third mode.

When the drum 10 rotates at the faster second rotation speed than the first rotation speed in the second mode, the rotor 54B may rotate at a high speed while a force is being applied in a downward direction in which the rotor 54B is located, and thus, the coupler 76 may be coupled to the rotor 54B. Accordingly, a probability that a bounce phenomenon occurs in the laundry amount sensing mode may be minimized.

Moreover, when the drum 10 rotates at the second rotation speed equal to or slower than a maximum rotation speed in sensing the amount of laundry in the second mode, the damage of the motor 54 or the coupler 76 caused by the very fast-speed driving of the drum 10 may be minimized.

According to another embodiment, the controller 90 may accelerate the drum 10 in each of the second mode and the below-described third mode, and at this time, the controller 90 may perform control so that an acceleration of the drum 10 in the second mode is equal to an acceleration of the drum 10 in the third mode. For example, an acceleration of the drum 10 in the second mode may be 0.8 to 1.2 times an acceleration of the drum 10 in the third mode.

For example, an acceleration of the drum 10 may be 24 rpm/s, but this is merely an embodiment. The present embodiment is not limited thereto.

As described above, driving may be performed similar to a driving pattern of the motor 54 in the laundry amount sensing mode before performing the laundry amount sensing mode, and thus, a possibility that a bounce phenomenon occurs in the laundry amount sensing mode may be minimized, thereby enhancing accuracy in sensing the amount of laundry.

The third process may be a process of initializing a driving speed value of the drum 10 after performing the second process.

A rotation speed of the drum 10 may be more accurately measured in a case, where the third process is performed before the drum 10 is driven (the third mode) at a laundry amount sensing rotation speed after the second mode is performed, than a case where the third process is performed before the drum 10 is driven (the third mode) at the laundry amount sensing rotation speed after the second mode is performed. That is, when the third process is performed, the laundry amount sensing rotation speed may be accurately measured, thereby enhancing reliability.

A time taken in the third process may be longer than a time taken in the first process. A rotation speed of the drum 10 before performing the third process may be faster than a rotation speed of the drum 10 before performing the first process, and thus, a time taken in the third process may be longer than a time taken in the first process.

Control may be performed so that a time taken in the first process is longer than a time taken in the third process, thereby minimizing a time taken in the second mode.

The controller 90 may control the drum 10 to the first mode and the second mode, and then, may control the drum 10 to the third mode of rotating the drum 10 at the laundry amount sensing rotation speed (S17).

That is, the controller 90 may drive the drum 10 at the laundry amount sensing mode, and in the laundry amount sensing mode, the drum 10 may be driven at the laundry amount sensing rotation speed.

Here, the third mode may be a mode of rotating the drum 10 at the laundry amount sensing mode. In the third mode, the controller 90 may accelerate the drum 10 up to the first target speed, maintain the first target speed as a uniform speed for a predetermined time, and decelerate the drum up to a second target speed. Here, the second target speed may be a speed which is set slower than the first target speed.

The controller 90 may additionally perform a process of maintaining a rotation speed of the drum 10 at the second target speed.

That is, the laundry amount sensing mode may be a mode of accelerating a rotation speed of the drum 10 to the first target speed, maintaining the rotation speed of the drum 10 as a uniform speed, decelerating the rotation speed of the drum 10 to the second target speed in the middle of maintaining the uniform speed, and maintaining a decelerated rotation speed.

The second rotation speed of the second mode according to an embodiment of the present invention may be the same speed as the first target speed and may be a rotation speed within an error range (−10% to +10%) of the first target speed.

A drum acceleration of the second mode according to an embodiment of the present invention may be an acceleration the same speed as the first target speed and may be an acceleration within an error range (−20% to +20%) of an acceleration up to the first target speed in the third mode.

The controller 90 may control the drum 10 to the third mode, and then, may sense the amount of laundry (S19).

That is, the controller 90 may sequentially perform the first mode, the second mode, and the third mode, and then, may sense the amount of laundry.

As described above, when the amount of laundry is sensed after compensating for a fastening defect of the coupler 76, the amount of laundry may be accurately sensed, and thus, it is possible to more accurately control the amount of supplied water. Accordingly, the amount of wasted washing water may be minimized, and the laundry may be washed at an appropriate washing intensity.

Figure 10:
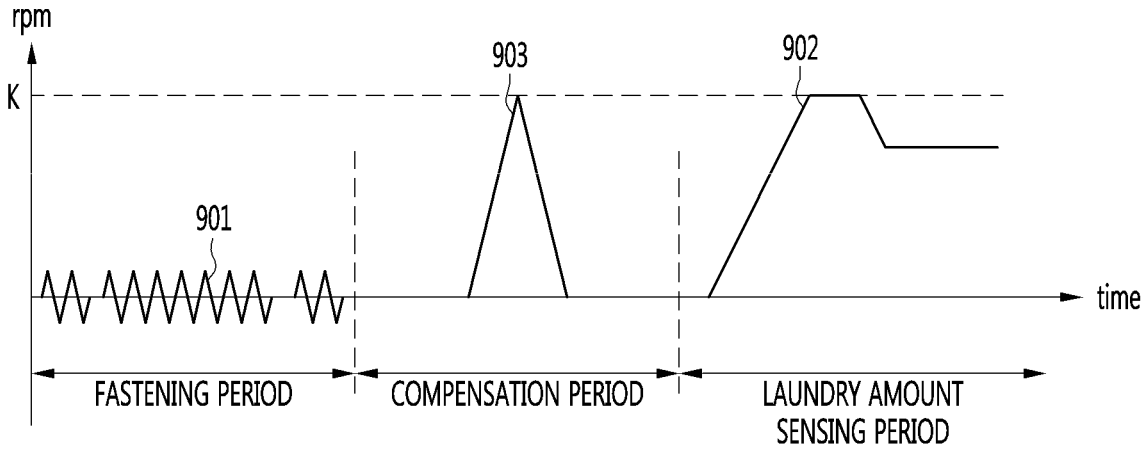
FIG. 10 is a graph illustrating a rotation speed variation of a drum when a motor operates, according to an embodiment of the present invention.

FIG. 10 is a graph illustrating a rotation speed variation of a drum when a motor operates, according to an embodiment of the present invention.

The graph illustrated in FIG. 10 shows a rotation speed of the drum 10 with respect to a time.

A fastening period may be a period where the drum 10 operates in the first mode. A first graph 901 may show the first rotation speed at which the drum 10 rotates in the first mode.

A compensation period may be a period where the drum 10 operates in the second mode. A second graph 903 may show the second rotation speed at which the drum 10 rotates in the second mode.

A laundry amount sensing period may be a period where the drum 10 operates in the third mode (the laundry amount sensing mode). A third graph 902 may show the laundry amount sensing rotation speed at which the drum 10 rotates.

As illustrated in FIG. 10, a maximum rotation speed of the second graph 903 may be faster than a maximum rotation speed of the first graph 901, and a maximum rotation speed of the second graph 903 may be equal to a maximum rotation speed of the third graph 902. Depending on the case, a maximum rotation speed of the second graph 903 may be slower than a maximum rotation speed of the third graph 902.

Moreover, an acceleration period acceleration of the second graph 903 may be equal to an acceleration period acceleration of the third graph 902.

As the drum 10 rotates as described above, the coupler 76 may be completely coupled to the rotor 54B through a fastening operation and a fastening compensation operation in lowering the coupler, and a possibility that a bounce period occurs in the laundry amount sensing period may be minimized. That is, a possibility that the bounce period occurs in the first graph 901 and the second graph 902 may be greater than a possibility that the bounce period occurs in the third graph 903. Accordingly, accuracy in sensing the amount of laundry may be enhanced, and an abnormal value in sensing the amount of laundry may be removed.

According to an embodiment of the present invention, a coupling defect where a coupler included in a washing machine is unstably coupled to a motor is minimized. Accordingly, an error occurrence possibility caused by a coupling detect of the coupler may be minimized in sensing the amount of laundry, and the amount of laundry may be more accurately sensed.

According to an embodiment of the present invention, without further adding a separate element, a fastening defect of the coupler may be compensated for by controlling the motor in the clutching mode, and thus, the increase in cost for enhancing a coupling rate of the coupler may be minimized and the reliability of a washing machine may be enhanced.

Moreover, according to an embodiment of the present invention, a probability that the coupler and the motor are damaged due to the excessive increase in a rotation speed of the motor may be minimized.

The description above is merely illustrative of the technical idea of the present invention, and various changes and modifications may be made by those skilled in the art without departing from the essential characteristics of the present invention.

Therefore, the embodiments disclosed in the present invention are intended to illustrate rather than limit the scope of the present invention, and the scope of the technical idea of the present invention is not limited by these embodiments.

The scope of protection of the present invention should be construed according to the following claims, and all technical ideas within the scope of equivalents should be construed as being included in the scope of the present invention.

What is claimed is:

1. A washing machine comprising:

a pulsator shaft configured to rotate a pulsator;

a drum shaft configured to rotate a drum;

a carrier connected to the drum shaft;

a motor comprising a stator and a rotor;

a coupler spline-coupled to the carrier and detachably connected to the rotor;

a clutch motor configured to raise or lower the coupler; and a controller configured to perform a first mode of controlling the clutch motor to a clutching mode and rotating the drum clockwise or counterclockwise at least once, a second mode of rotating the drum at a higher speed than the first mode, and a third mode of accelerating the drum, maintaining a rotation speed of the drum, and decelerating the drum.

2. The washing machine of claim 1, wherein the controller sequentially performs the first mode, the second mode, and the third mode.

3. The washing machine of claim 1, wherein, in the second mode, the controller rotates the drum in one direction of a clockwise direction and a counterclockwise direction.

4. The washing machine of claim 1, wherein, in the second mode, the controller rotates the drum in a direction which is opposite to a rotational direction of the drum in a previous dehydrating process.

5. The washing machine of claim 1, wherein a maximum rotation speed of the drum in the second mode is faster than a maximum rotation speed of the drum in the first mode and is equal to or slower than a maximum rotation speed of the drum in the third mode.

6. The washing machine of claim 1, wherein, in each of the second mode and the third mode, the controller accelerates a rotation of the drum, and an acceleration of the drum in the second mode is 0.8 to 1.2 times an acceleration of the drum in the third mode.

7. The washing machine of claim 1, wherein, in the first mode, the controller alternately rotates the drum clockwise and counterclockwise, in the second mode, the controller accelerates the drum up to a first target speed which is faster than a maximum speed in the first mode, and decelerates the drum, and in the third mode, the controller accelerates the drum up to the first target speed, maintains the first target speed as a uniform speed for a predetermined time, and decelerates the drum up to a second target speed which is slower than the first target speed.

8. The washing machine of claim 7, wherein the controller sequentially performs the first mode and the second mode, and in the third mode, the controller senses an amount of laundry.

9. The washing machine of claim 8, wherein, in the third mode, the controller senses the amount of laundry, based on a time required for deceleration from the first target speed to the second target speed.

10. The washing machine of claim 1, wherein, in the second mode, the controller sequentially performs a first process of stopping and maintaining the drum, a second process of accelerating the drum up to a first target speed after the first process and decelerating the drum, and a third process of stopping and maintaining the drum after the second process.

11. The washing machine of claim 10, wherein, in the second mode, a time taken in the third process is longer than a time taken in the first process.

* * * * *